US006923358B2

(12) United States Patent
Chandaria

(10) Patent No.: US 6,923,358 B2
(45) Date of Patent: Aug. 2, 2005

(54) TAPE DISPENSER WITH CUTTER SHIELD

(76) Inventor: Ashok V. Chandaria, P.O. Box 48870, Nairobi (KE)

( * ) Notice: Subject to any disclaimer, the term of this patent is extended or adjusted under 35 U.S.C. 154(b) by 0 days.

(21) Appl. No.: 10/293,167

(22) Filed: Nov. 12, 2002

(65) Prior Publication Data

US 2004/0089690 A1 May 13, 2004

(51) Int. Cl.[7] ..... B26F 3/02

(52) U.S. Cl. ..... 225/56; 225/66; 225/77; 156/527

(58) Field of Search ..... 225/561, 77, 65, 225/66, 57, 56; D19/69; 156/577, 579, 574, 527

(56) References Cited

U.S. PATENT DOCUMENTS

| | | | | | |
|---|---|---|---|---|---|
| D197,157 | S | * | 12/1963 | Casey | D19/69 |
| D259,643 | S | * | 6/1981 | Pearson | D19/69 |
| D276,354 | S | * | 11/1984 | Spitzer | D19/69 |
| 4,961,525 | A | * | 10/1990 | Corbo et al. | 225/56 |
| 5,167,357 | A | * | 12/1992 | Shih | 225/47 |
| D362,684 | S | * | 9/1995 | Samuelson et al. | D19/69 |
| 5,468,332 | A | * | 11/1995 | Dretzka et al. | 225/77 |
| 5,878,932 | A | * | 3/1999 | Huang | 225/65 |
| 5,921,450 | A | * | 7/1999 | Robinson | 225/56 |
| D423,054 | S | * | 4/2000 | Harris | D19/69 |
| D442,227 | S | * | 5/2001 | Carlson et al. | D19/69 |
| D448,413 | S | * | 9/2001 | Carlson et al. | D19/69 |
| D463,825 | S | * | 10/2002 | Carlson et al. | D19/69 |
| 6,491,082 | B1 | * | 12/2002 | Fu | 225/56 |
| 6,669,070 | B2 | * | 12/2003 | Huang | 225/56 |
| 6,705,374 | B2 | * | 3/2004 | Yu Chen | 225/56 |
| 6,719,180 | B2 | * | 4/2004 | Shah | 225/56 |
| 6,789,594 | B1 | * | 9/2004 | Yu Chen | 225/56 |
| 6,874,554 | B2 | * | 4/2005 | Chandaria | 156/527 |
| 2004/0040670 | A1 | * | 3/2004 | Chandaria | 156/577 |
| 2004/0154750 | A1 | * | 8/2004 | Chandaria | 156/577 |

* cited by examiner

*Primary Examiner*—Allan N. Shoap
*Assistant Examiner*—Jason Prone
(74) *Attorney, Agent, or Firm*—Sand & Sebolt

(57) ABSTRACT

A tape dispenser has a housing with a cutting end to which a blade is connected. The blade has a cutting edge extending outwardly beyond the cutting end of the housing. A shield is positioned adjacent the cutting edge of the blade to reduce the exposure of the cutting edge to reduce the risk or extent of potential injury.

18 Claims, 13 Drawing Sheets

REPLACEMENT SHEET

TAPE DISPENSER WITH CUTTER SHIELD

BACKGROUND OF THE INVENTION

1. Technical Field

The invention relates generally to hand-held adhesive-tape dispensers for ordinary household and office use. More particularly, the invention relates to tape dispensers used with the generally "wide" tape used to seal boxes, cartons and the like. Specifically, the invention relates to such tape dispensers with a shield that reduces the exposure of the cutting edge as a safety feature.

2. Background Information

Tape dispensers are known in the art, including those generally in use with "wide" tape usually used for sealing boxes for shipping and the like. These dispensers have a variety of cutting edges, most commonly made of plastic and metal. Metal blades generally provide a sharper blade and last longer. However, to create a sharp and effective blade, the angle of the cutting edge of the blade must be sufficiently acute. Due to this requirement, the cutting edge of the blade extends farther than is actually needed to cut the tape, and thus presents a danger to the user by this additional extension.

Thus, the art needs a dispenser which can utilize the benefits of the metal blade while reducing the danger thereof. The shield of the present invention solves this problem by reducing the exposure of the cutting edge while preserving an effective cutting angle.

BRIEF SUMMARY OF THE INVENTION

The invention provides a tape dispenser with a housing having a cutting end and being adapted to dispensably house tape. A blade is connected to the housing and has a cutting edge extending outwardly beyond the cutting end of the housing. A shield is positioned adjacent the cutting edge of the blade and is adapted to reduce the exposure of the cutting edge to limit injury.

BRIEF DESCRIPTION OF THE DRAWINGS

Similar numerals refer to similar parts throughout the specification.

DETAILED DESCRIPTION OF THE INVENTION

Figure 1:
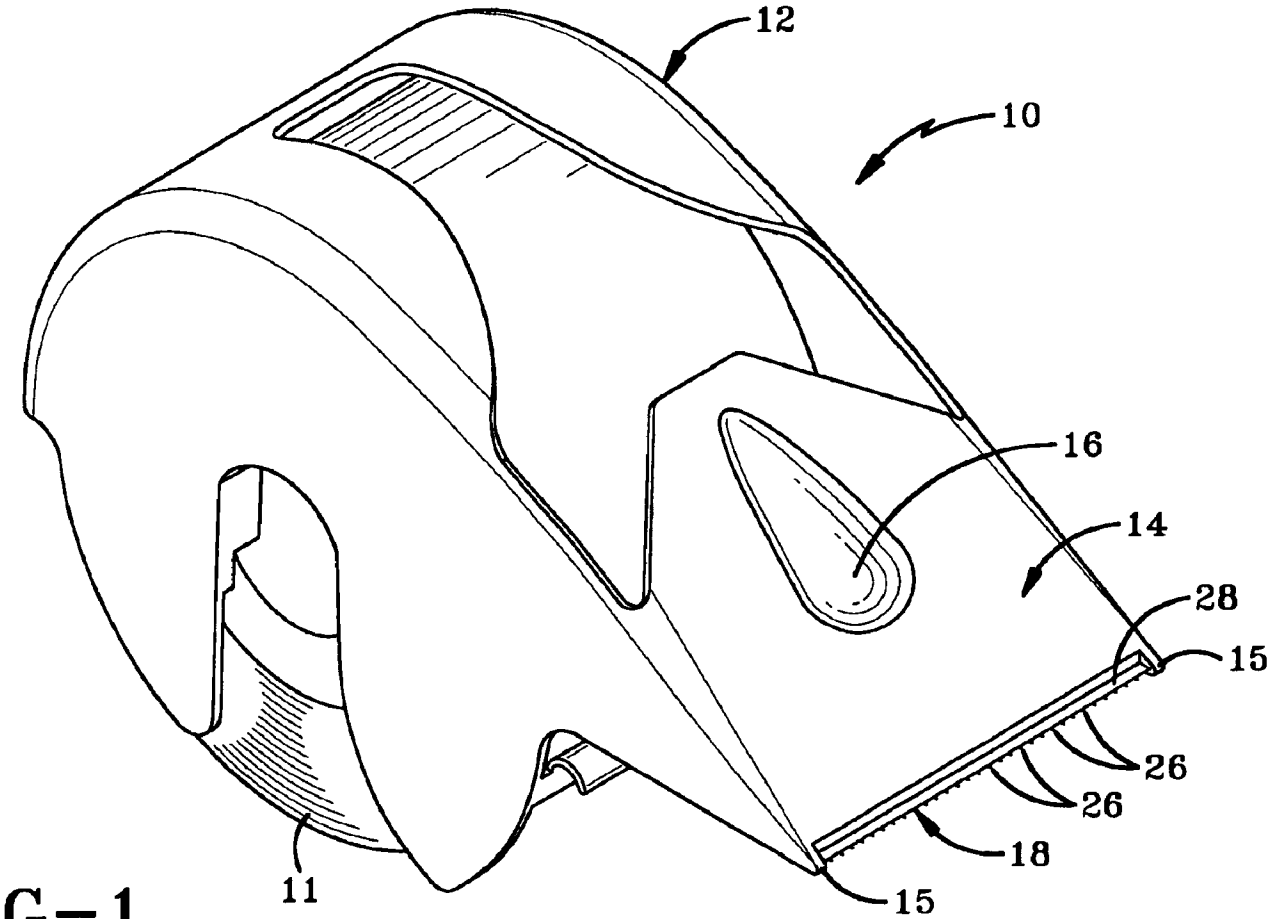
FIG. 1 is a perspective view of the tape dispenser of the present invention.

The tape dispenser of the present invention is shown generally at 10, and is shown particularly in FIGS. 1–8 and 10. Dispenser 10 includes housing 12, blade 18 and shield 28 and is configured to reduce injuries or the severity of injuries to the user. Dispenser 10 is generally used with "wide" tape used in sealing boxes and the like, although the invention can be used with various tapes or other sheet-like materials without departing from the spirit of the invention. Hand-held dispensers like dispenser 10 present a greater chance of injury than stationary dispensers due to the need to move the dispenser and because the tape generally used therein often requires greater pressure to cut than "narrow" tape, that is, tape that is not as thick or is made of a material that is easier to cut. Also the blades on hand-held dispensers are often sharper and more exposed than their stationery counterparts.

Housing 12 may be formed of a rigid material such as plastic and dispensably houses a roll of adhesive tape 11, although tape 11 may be any tape or sheets of material which can be dispensed and cut by dispenser 10. Housing 12 may comprise a single member or a plurality of members, and is configured to allow replacement of tape 11. Housing 12 includes outwardly extending cutting end 14, to which are connected blade 18 and shield 28. A pair of opposing tabs 15 extend outwardly from cutting end 14. Cutting end 14 of housing 12 also defines finger hole 16, which is an indentation which gives the user a better grip on dispenser 12 and is the subject of the pending patent application having Ser. No. 10/232,236, which is incorporated herein by reference.

Blade 18 is substantially flat and has an inner surface 20, an outer surface 22 and a serrated cutting edge 24 which may have a plurality of tips 26 defining a plurality of grooves 27 therebetween. Blade 18 may also have a straight cutting edge or a cutting edge disposed in other configurations. Blade 18 may be made of various materials, although metal is preferred for its ability to define and maintain a long-lasting and sharp cutting edge 24. Cutting edge 24 extends outwardly beyond cutting end 14 of housing 12. Blade 18 further defines a plurality of holes 25 by which blade 18 is connected to cutting end 14 of housing 12 with fasteners 30, which may be rivets, screws, bolts or the like. Blade 18 may also be connected to cutting end 14 with glue or sonically welded plastic. Other connection arrangements known to those skilled in the art may be used to hold blade 18 in place.

Figure 2:
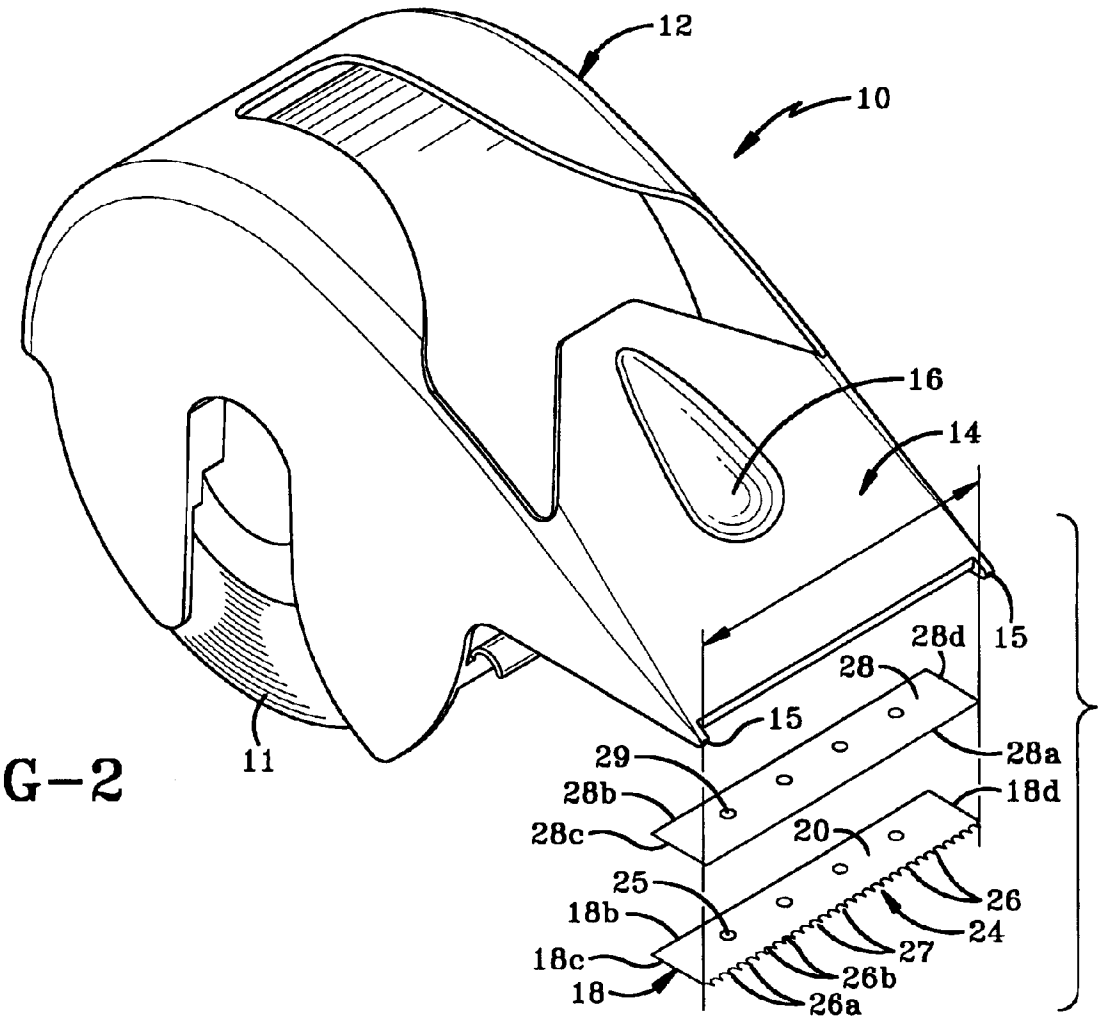
FIG. 2 is a partially exploded perspective view of the tape dispenser.
Figure 3:
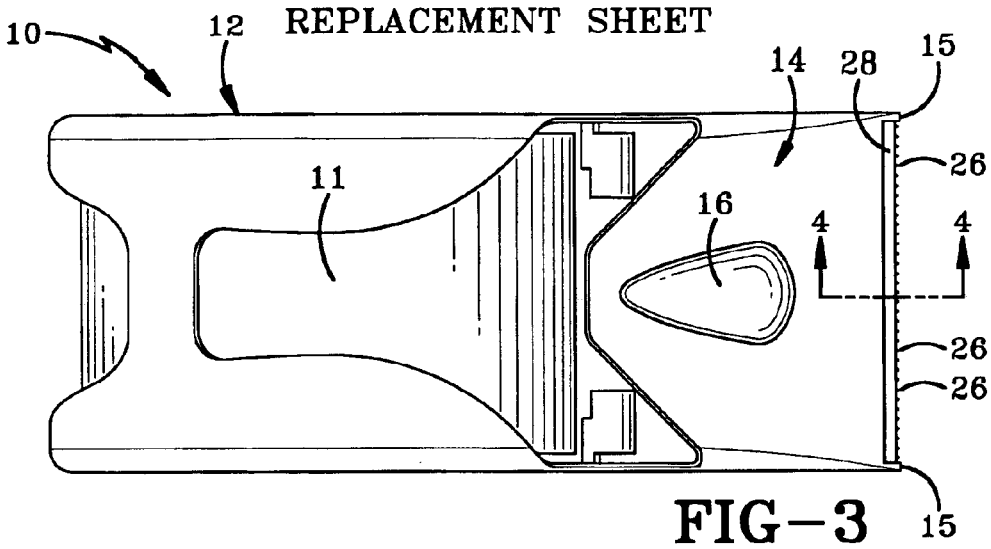
FIG. 3 is a top plan view of the tape dispenser.
Figure 4:
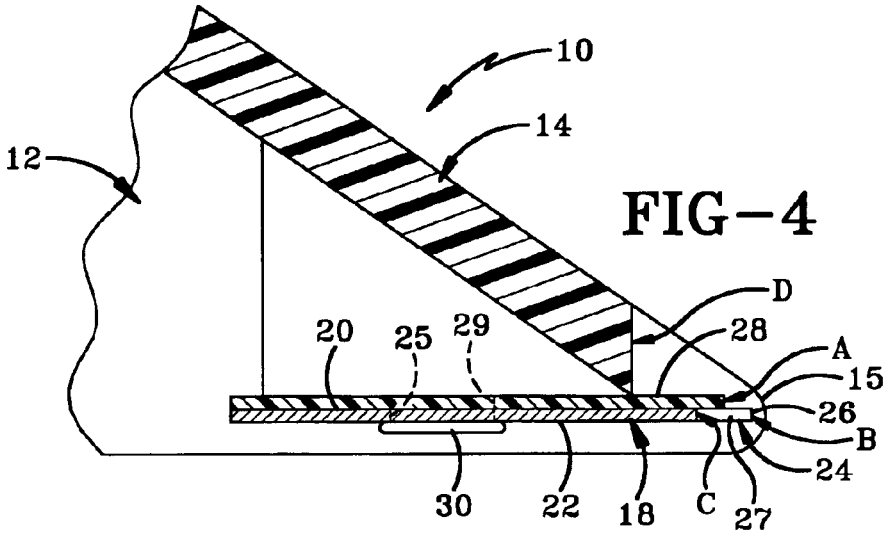
FIG. 4 is a fragmentary sectional view of the tape dispenser taken on line 4—4, FIG. 3.

Shield 28 is substantially flat and made of plastic, although other suitable materials may be used. Shield 28 defines a plurality of holes 29 and is disposed between blade 18 and cutting end 14 of housing 12. Shield 28 is connected to blade 18 and cutting end 14 by fasteners 30 which hold blade 18 to cutting end 14. The fasteners 30 or other means of connection may vary as described above. Referring to FIG. 2, it can be seen that shield 28 has a front edge 28*a*, a rear edge 28*b* and side edges 28*c*, 28*d*. Shield 28 has a length which extends from side edge 28*c* to side edge 28*d*. Blade 18 has a cutting edge 24, a rear edge 18*b* and side edges 18*c*,

18*d*. Blade 18 has a length which extends from side edge 18*c* to side edge 18*d*. Blade 18 and shield 28 preferably have the same length. Shield 28 is positioned adjacent inner surface 20 of blade 18 to reduce the exposure of cutting edge 24, which would otherwise extend father outwardly from housing 12. Shield 28 functions to reduce the severity of an injury by limiting the depth of a cut that can be caused by blade 18. Shield 28 extends outwardly beyond cutting end 14 which helps prevent injury by additionally reducing exposure of blade 18. The thickness of shield 28 preferably ranges from equal to the thickness of blade 18 to twice the thickness of blade 18 to help prevent injury by reducing the exposure of blade 18. Blade 18 and shield 28 are disposed between tabs 15, which also helps prevent injury. Referring to FIG. 4 it can also be seen that when shield 28 and blade 18 are secured together, front edge "A" of shield 28 lies rearwardly of the tips "B" of teeth 26 on blade 18. Furthermore, front edge "A" of shield 28 also lies forwardly of the troughs "C" of teeth 26 and of outermost edge "D" of upper wall 14 of housing 12.

Figure 4A:
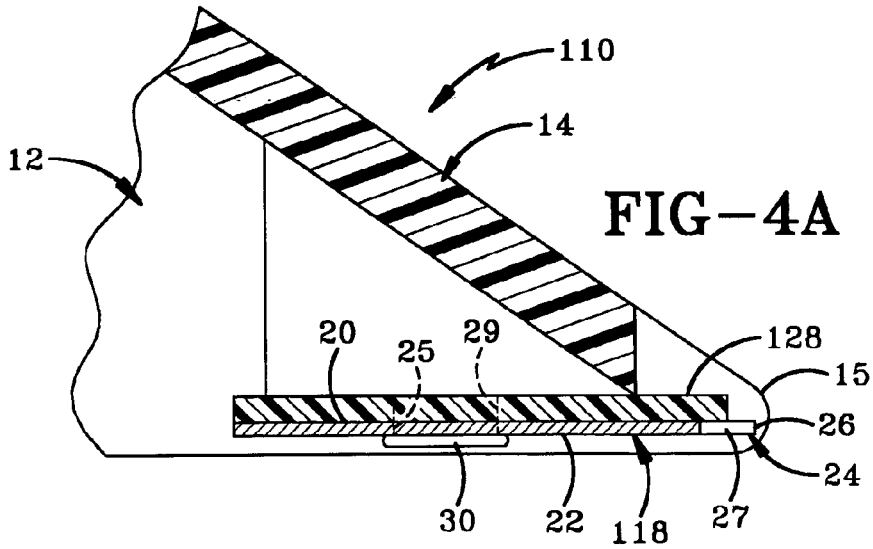
FIG. 4*a* is a fragmentary sectional view of the tape dispenser where the dispenser includes a shield that is twice the thickness of the blade.
Figure 3A:
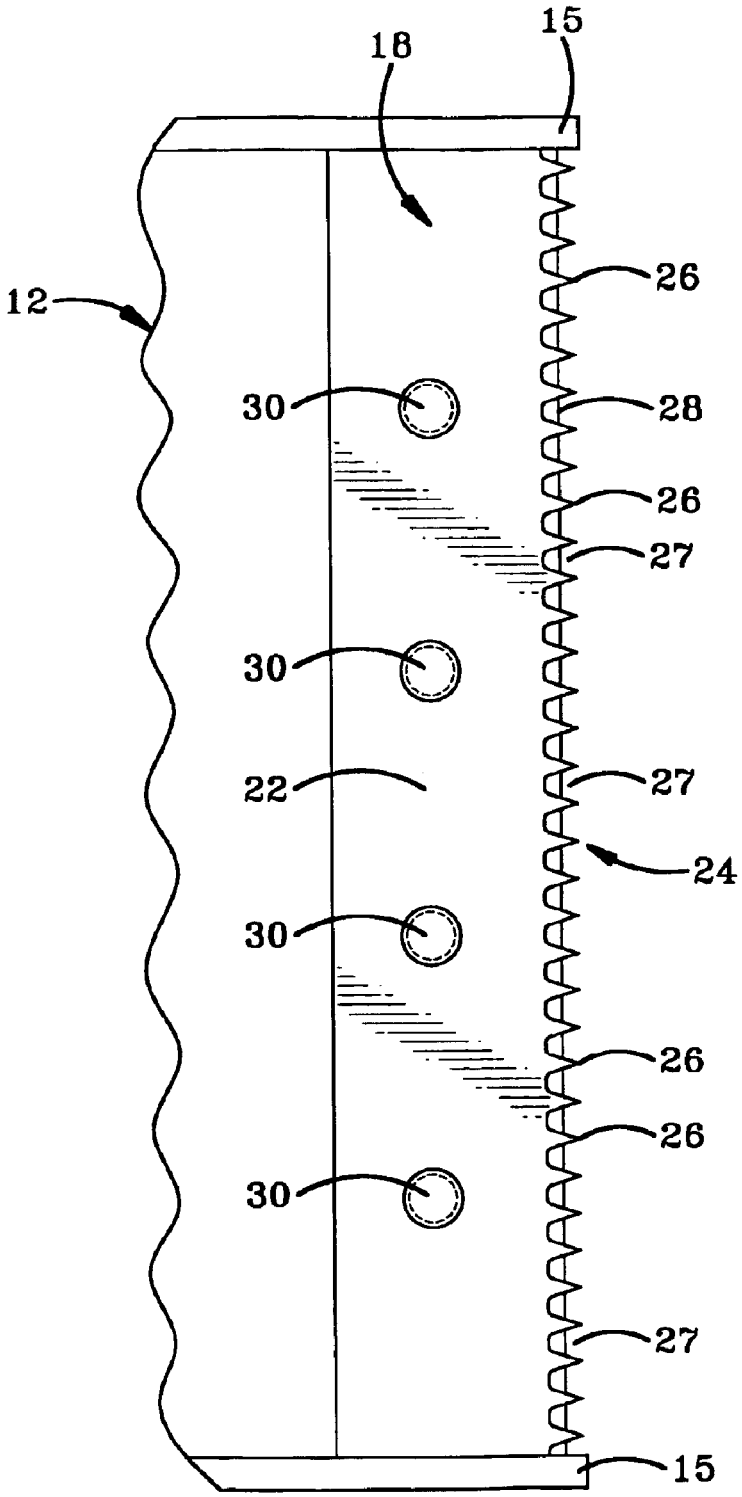
FIG. 3*a* is a partial bottom plan view of the tape dispenser showing the relationship between the shield and blade in greater detail.
Figure 5:
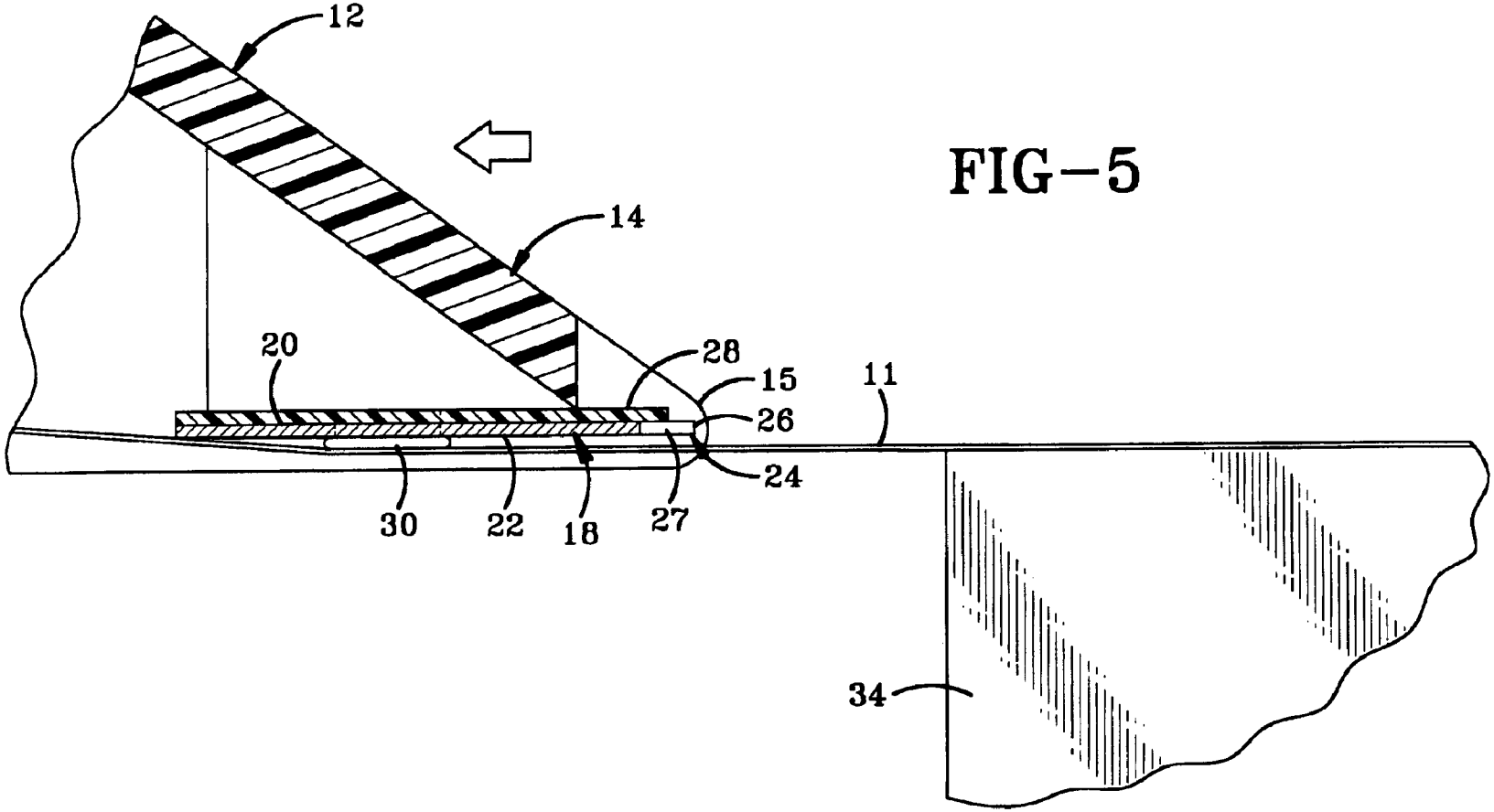
FIG. 5 is a fragmentary sectional view of the tape dispenser showing one stage of adhesive tape being applied to a box.
Figure 6:
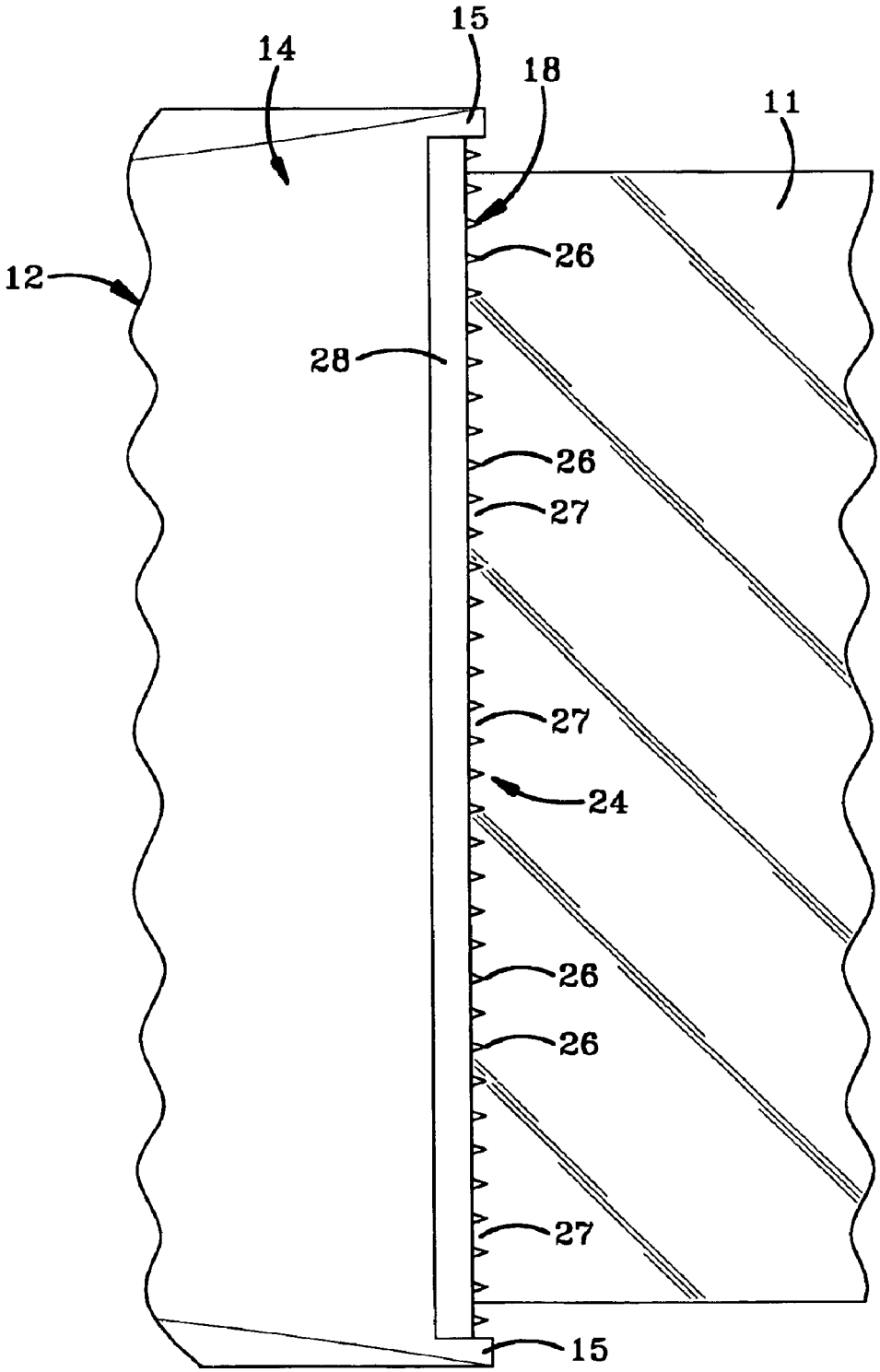
FIG. 6 is a fragmentary top plan view of the tape dispenser and adhesive tape prior to cutting the tape.
Figure 7:
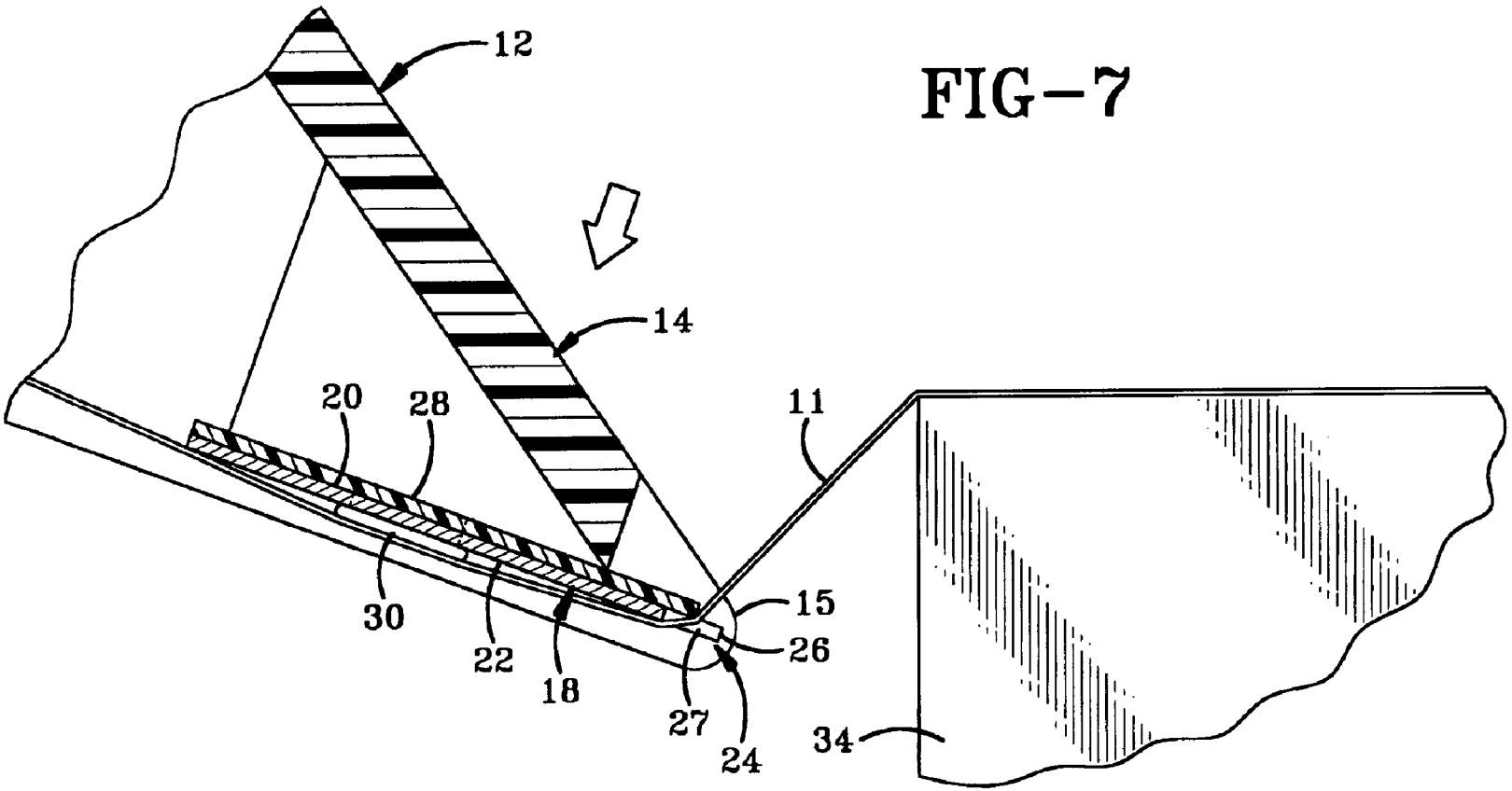
FIG. 7 is a fragmentary sectional view of the of the tape dispenser showing a further stage of applying adhesive tape to a box in which the cutting edge of the blade is engaging the tape.
Figure 8:
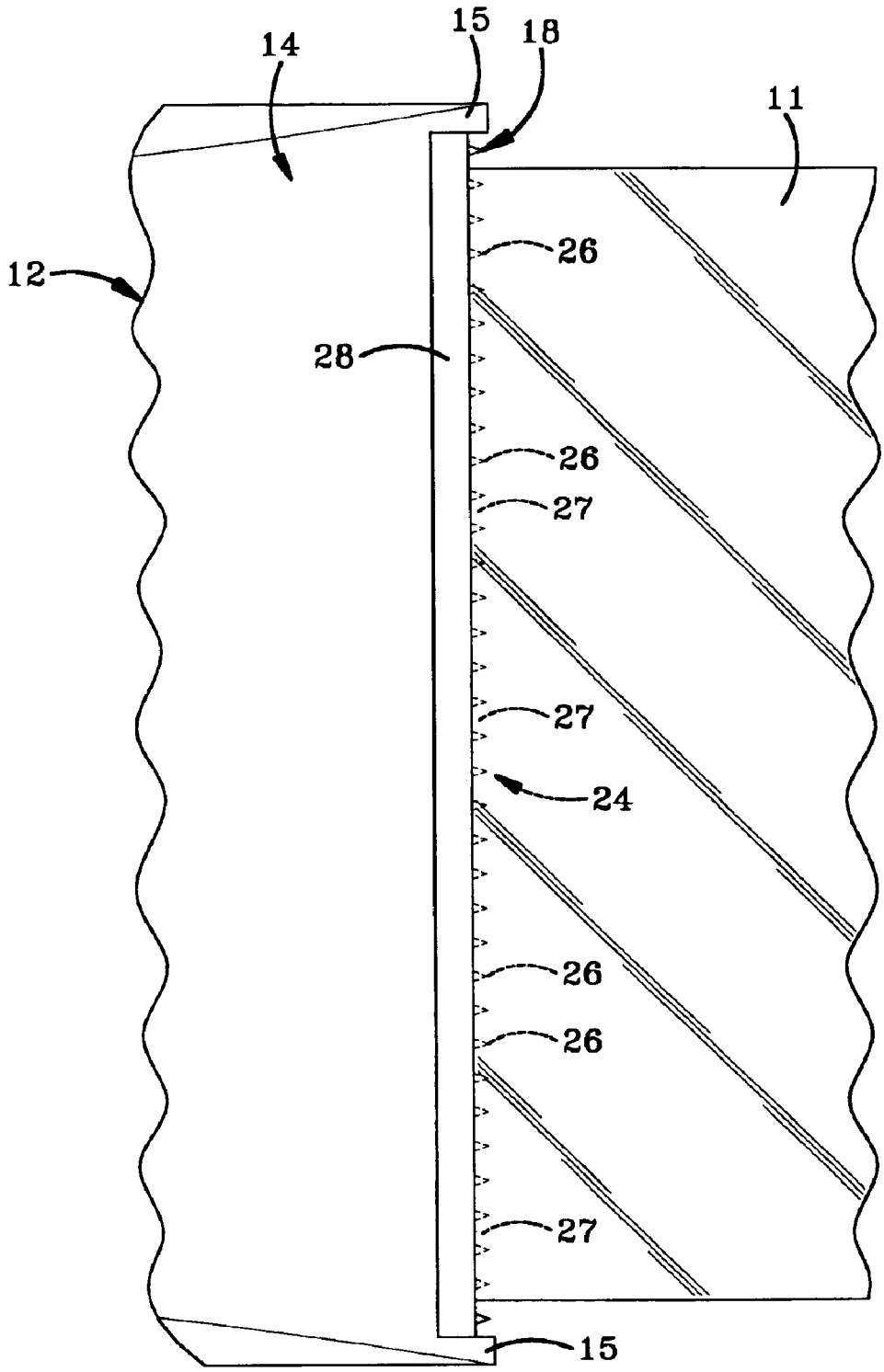
FIG. 8 is a fragmentary top plan view of the tape dispenser showing the tips of the serrated cutting blade cutting through the adhesive tape.

FIG. 4*a* shows a front end of a second embodiment of tape dispenser 110. Tape dispenser 110 includes a shield 128 that is twice the thickness of the blade 118. All other numbers reference the identical components to those shown in the first embodiment of tape dispenser.

Figure 9:
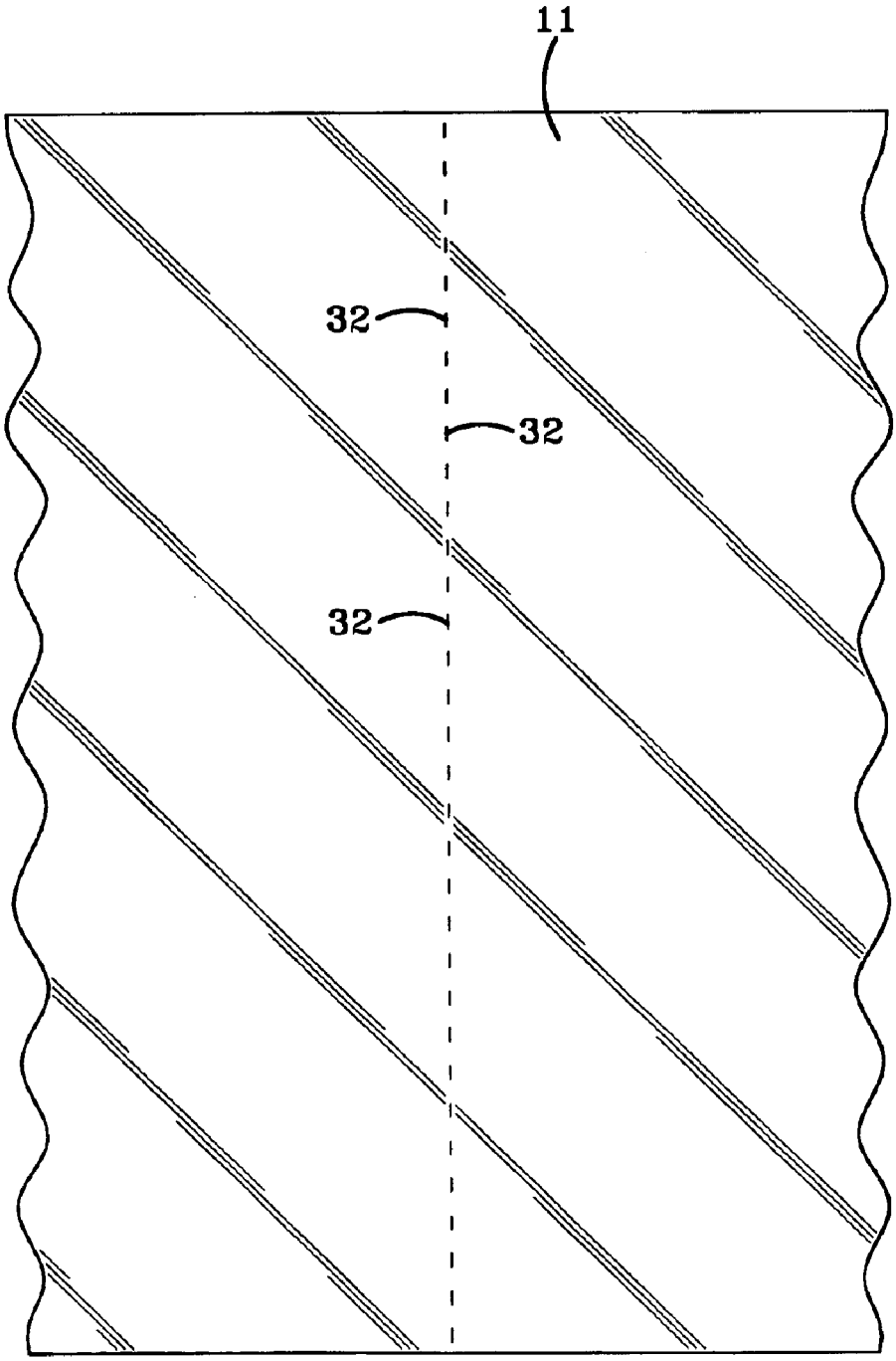
FIG. 9 is a fragmentary top plan view of adhesive tape showing the slits made by the tips of the cutting blade.
Figure 10:
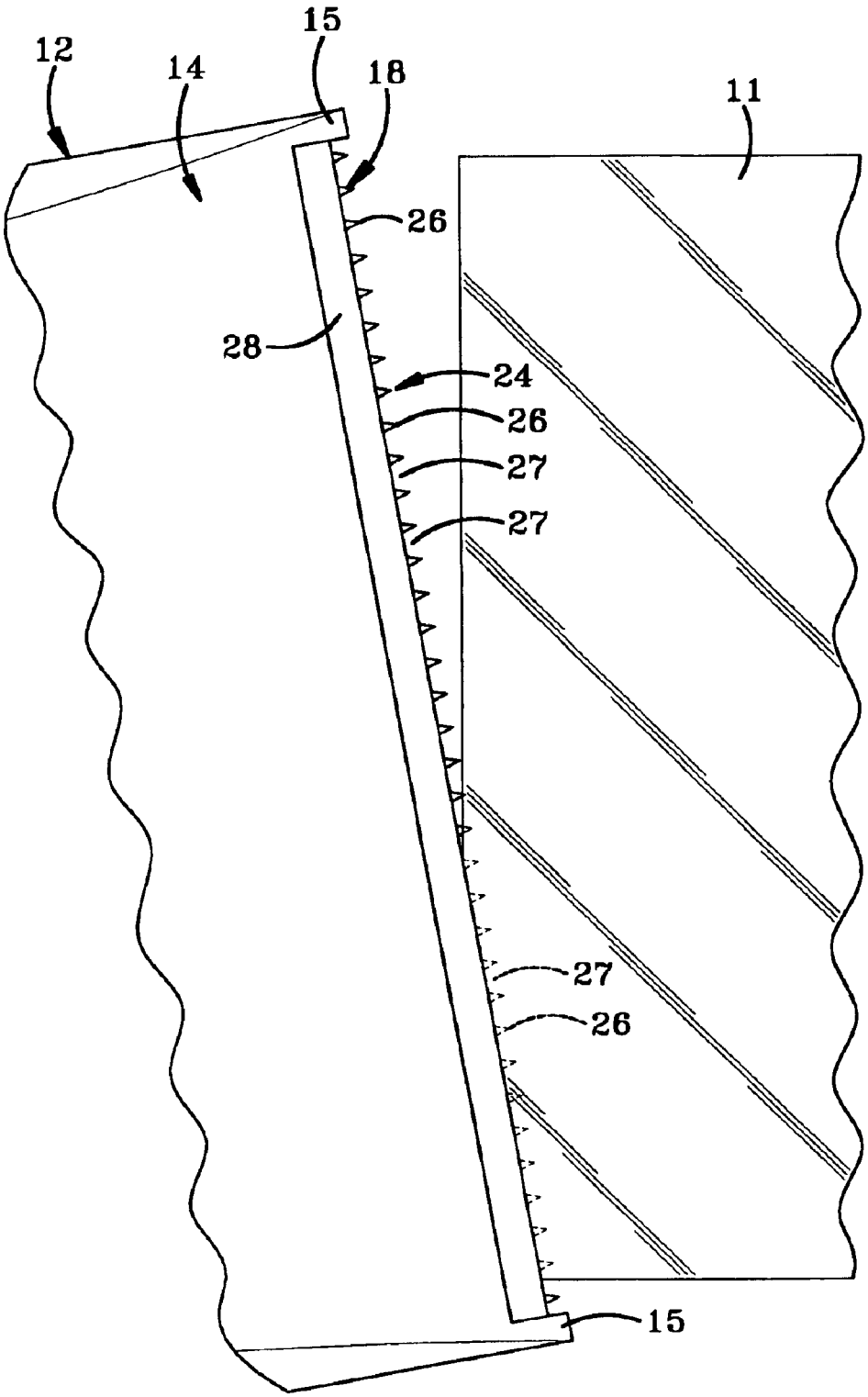
FIG. 10 is a fragmentary top plan view of the tape dispenser showing adhesive tape partially cut and being separated from the dispenser.
Figure 11:
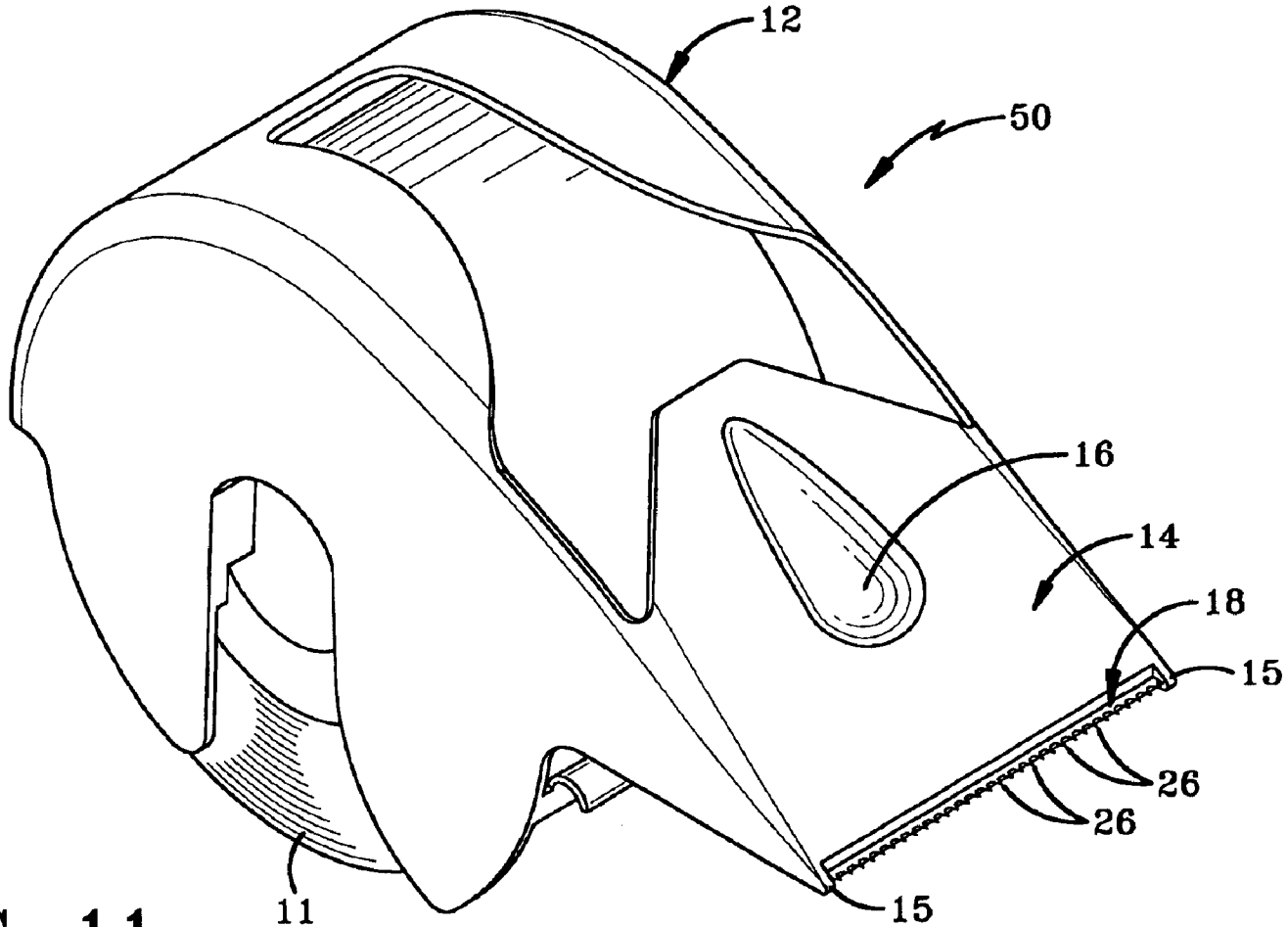
FIG. 11 is a perspective view of a second embodiment of the tape dispenser of the present invention.
Figure 12:
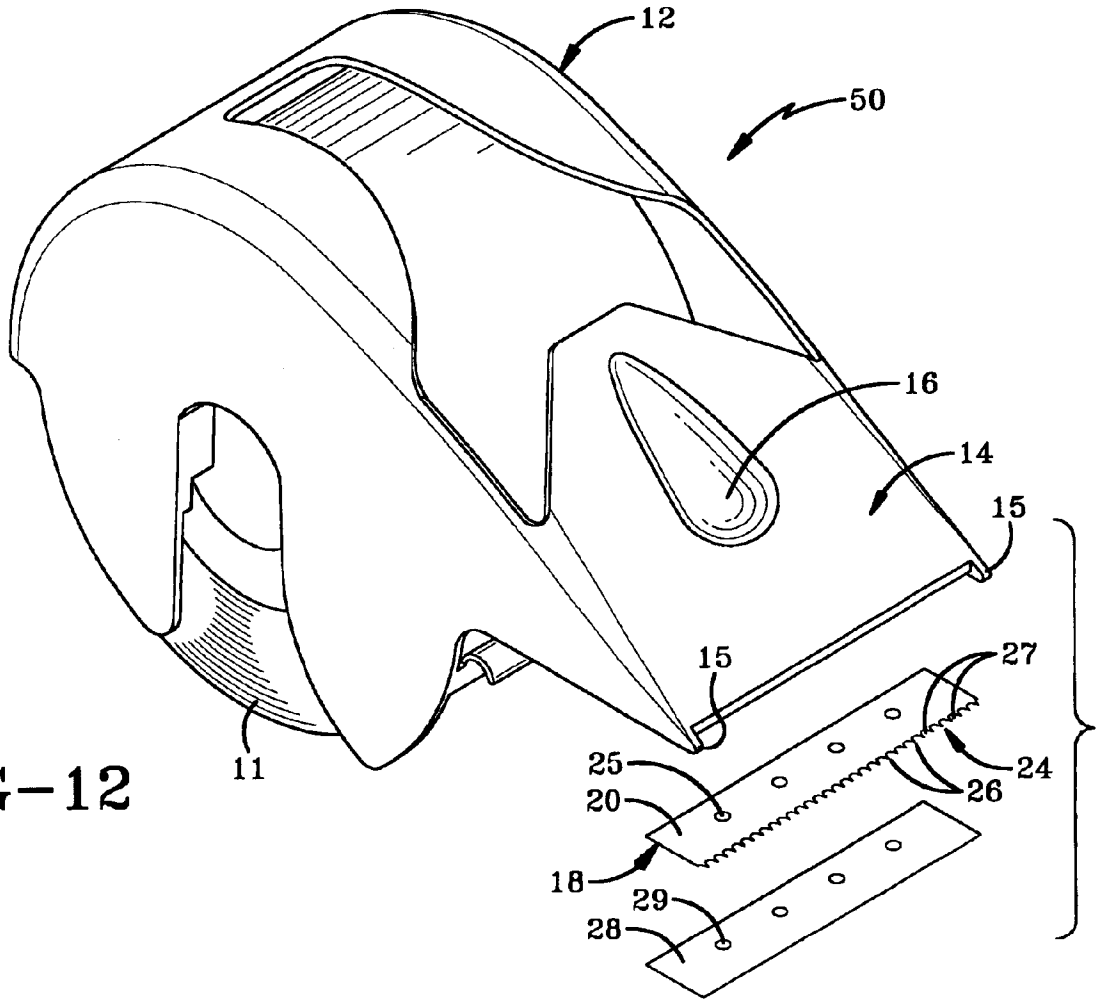
FIG. 12 is a partially exploded perspective view of the second embodiment.
Figure 13:
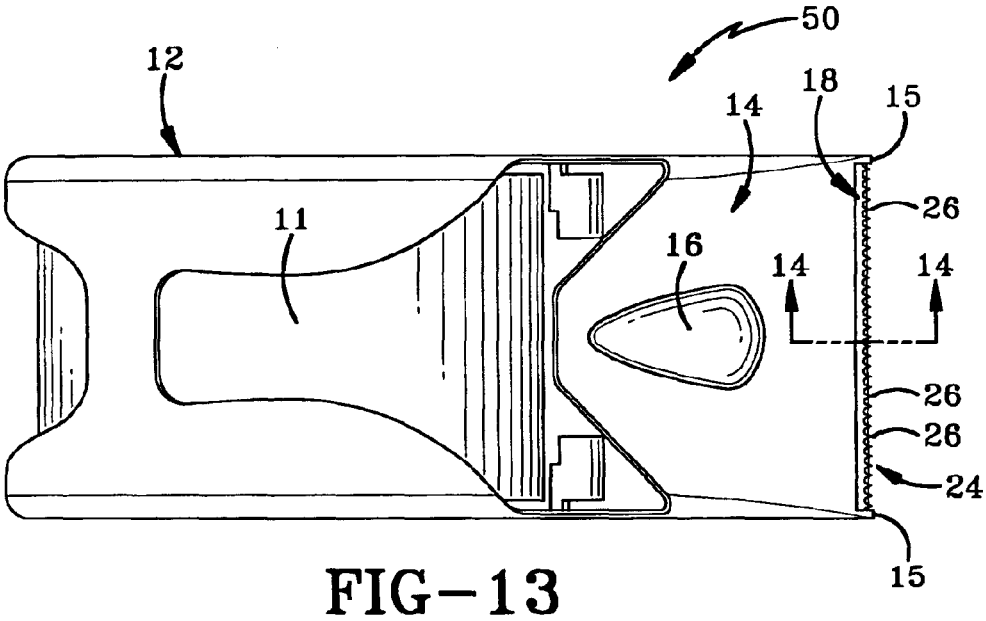
FIG. 13 is a top plan view of the second embodiment.
Figure 14:
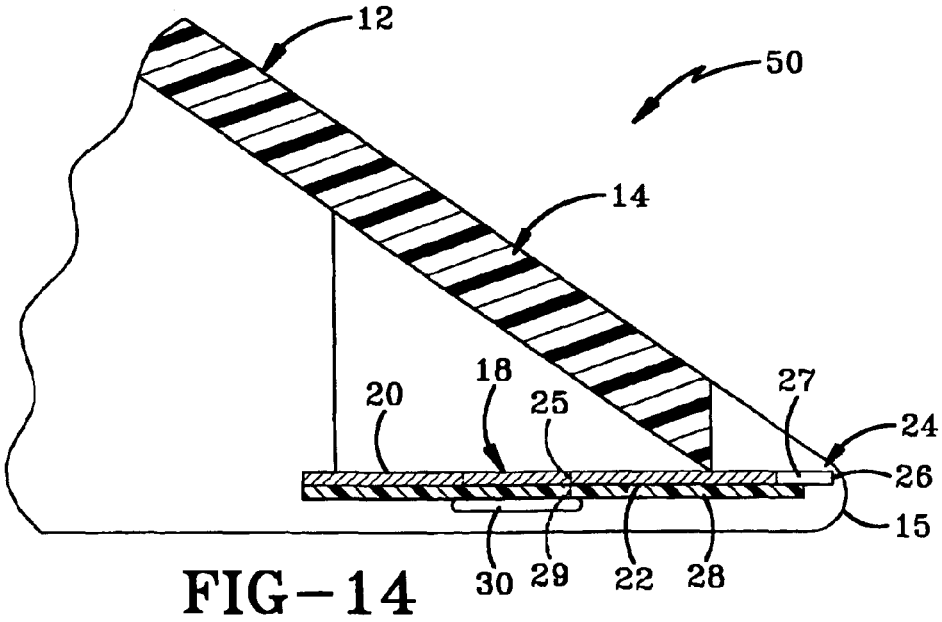
FIG. 14 is a fragmentary sectional view of the second embodiment taken on line 14—14, FIG. 13.

Dispenser 10 effectively cuts tape 11 and also reduces the severity of accidental injury as a result of shield 28 reducing the exposure of cutting edge 24, especially the depth of cutting edge 24 that is exposed. Where cutting edge 24 is serrated, shield 28 is positioned to expose only tips 26, although any portion of tips 26 and cutting edge 24 may be exposed. Tape 11 engages tips 26 (FIGS. 7–8) to form a plurality of small slits 32 in tape 11 across its width (FIG. 9). In combination with applying some pressure to or pulling against tape 11 (FIG. 10), slits 32 effectively cut tape 11. Dispenser 10 is effective for applying tape 11 to a box 34 (FIGS. 5 and 7) or other item. While dispenser 10 is configured to apply adhesive tape 11 to various items, the scope of the invention includes the dispensing and cutting of any tape or sheet-like material, adhesive or not, which is susceptible to being cut as described herein.

A second embodiment of the present invention is shown generally at 50 in FIGS. 11–14 and is similar to dispenser 10 except that blade 18 and shield 28 have switched places. In dispenser 50, blade 18 is connected along inner surface 20 to housing 12 and shield 28 is connected to outer surface 22 of blade 18. The use of dispenser 50 is essentially the same as dispenser 10, although in dispenser 50, tape 11 would make contact with shield 28 in the process of dispensing and cutting tape 11.

In the foregoing description, certain terms have been used for brevity, clearness and understanding, but no unnecessary limitations are to be implied therefrom beyond the requirement of the prior art, because such terms are used for descriptive purposes and are intended to be broadly construed. Moreover, the description and illustration of the invention is by way of example, and the scope of the invention is not limited to the exact details shown or described.

Having now described the features, discoveries and principles of the invention, the manner in which the improved tape dispenser with cutter shield is constructed and used, the characteristics of the construction, and the advantageous, new and useful results obtained; the new and useful structures, devices, elements, arrangements, parts and combinations are set forth in the appended claims.

What is claimed is:

1. A tape dispenser comprising:

a housing having a tape roll-retaining end and a tape culling end, the housing being generally U-shaped in cross-section having an upper wall with an inner surface and an outer surface and having opposed spaced apart side walls extending downwardly from the upper wall;

a blade connected to the cutting end of the housing and having a cutting edge extending outwardly beyond an outermost edge of the upper wall of the housing; the cutting edge including a plurality of teeth each having a tip and a trough; and an immobile shield mounted to the housing adjacent the blade and below the upper wall of the housing, the shield having a front edge which lies rearwardly of the tips of the teeth and forwardly of both the troughs of the teeth and the outermost edge of the upper wall; whereby the shield reduces the exposure of the cutting edge during operation of the dispenser.

2. The dispenser as defined in claim 1 wherein the shield and the blade are substantially flat.

3. The dispenser as defined in claim 2 wherein the shield and the blade are of the same length.

4. The dispenser as defined in claim 3 in which the blade has a thickness and the shield has a thickness ranging from equal to the thickness of the blade to twice the thickness of the blade.

5. The dispenser as defined in claim 4 wherein the upper surface of the upper wall of the housing defines an indentation adapted to hold the tip of a user's finger thereon.

6. The dispenser as defined in claim 5 wherein the shield is plastic.

7. The dispenser as defined in claim 6 wherein the blade is metal.

8. The dispenser as defined in claim 7 wherein the housing is plastic.

9. The dispenser as defined in claim 4, wherein the thickness of the shield is twice the thickness of the blade.

10. The dispenser as defined in claim 1 in which a pair of tabs extend outwardly from the side walls of the housing and beyond the outermost edge of the upper wall; and wherein the blade and shield are disposed between the tabs.

11. The dispenser as defined in claim 10 wherein the upper wall of the housing defines an indentation adapted to hold the tip of a user's finger thereon.

12. The dispenser as defined in claim 11 wherein the shield is plastic.

13. The dispenser as defined in claim 12 wherein the blade is metal.

14. The dispenser as defined in claim 13 wherein the housing is plastic.

15. The dispenser as defined in claim 1, wherein the shield is fixedly connected to the blade; whereby the position of the shield relative to the blade and to the inner surface of the upper wall remains unchanged during use and non-use of the dispenser.

16. The dispenser as defined in claim 15, wherein the shield is fixedly connected to the inner surface of the upper wall of the housing.

17. The dispenser as defined in claim 1, wherein the shield is mounted to the housing between the blade and the inner surface of the upper wall.

18. The dispenser as defined in claim 1, wherein the shield is mounted to the housing so that the blade lies between the shield and the inner surface of the upper wall.

* * * * *

UNITED STATES PATENT AND TRADEMARK OFFICE

CERTIFICATE OF CORRECTION

PATENT NO. : 6,923,358 B2
DATED : August 2, 2005
INVENTOR(S) : Ashok V. Chandaria It is certified that error appears in the above-identified patent and that said Letters Patent is hereby corrected as shown below:

Column 4,
Line 4, replace the word "culling" with the word -- cutting --.

Signed and Sealed this

Fourth Day of October , 2005

JON W. DUDAS
*Director of the United States Patent and Trademark Office*